US010178895B1

(12) United States Patent
Huang

(10) Patent No.: US 10,178,895 B1
(45) Date of Patent: Jan. 15, 2019

(54) DUAL KEY RING

(71) Applicant: HOEY CO., LTD., Taoyuan (TW)

(72) Inventor: Joseph Huang, Taoyuan (TW)

(73) Assignee: HOEY CO., LTD., Taoyuan (TW)

( * ) Notice: Subject to any disclaimer, the term of this patent is extended or adjusted under 35 U.S.C. 154(b) by 0 days.

(21) Appl. No.: 15/847,882

(22) Filed: Dec. 19, 2017

(30) Foreign Application Priority Data

Oct. 16, 2017 (TW) ..... 106215166 U

(51) Int. Cl.
*A44B 15/00* (2006.01)

(52) U.S. Cl.
CPC ..... *A44B 15/00* (2013.01)

(58) Field of Classification Search
CPC ..... A44B 15/00; A44B 15/002; A47G 29/10
USPC ..... 70/408, 456 R, 456 B, 459, 460; 24/3.6, 24/115 G, 599.5, 601.1; 206/37.1–37.8, 206/38.1
See application file for complete search history.

(56) References Cited

U.S. PATENT DOCUMENTS 2,307,808 A * 1/1943 Segal ..... A44B 15/00 24/115 G
4,584,858 A 4/1986 Wolter
4,821,543 A * 4/1989 Scungio ..... A44B 15/00 206/37.1
5,058,405 A * 10/1991 Stillwagon ..... A44C 5/2052 70/456 R
5,363,680 A * 11/1994 Wu ..... A45F 5/02 206/37.6
5,457,976 A * 10/1995 Stillwagon ..... A44B 15/002 24/3.6
5,685,185 A * 11/1997 MacDonald ..... A47G 29/10 70/456 R
5,752,401 A * 5/1998 MacDonald ..... A44B 15/002 70/456 R
6,260,245 B1 * 7/2001 Marsetti ..... B65G 21/2072 198/836.3
6,668,608 B1 * 12/2003 Derman ..... A44B 15/002 70/34
6,826,938 B2 * 12/2004 Huang ..... A44B 15/00 70/456 R
6,848,287 B1 * 2/2005 Huang ..... A44B 15/00 24/3.6
6,848,288 B1 * 2/2005 Derman ..... A44B 15/002 24/303

* cited by examiner

*Primary Examiner* — Lloyd A Gall
(74) *Attorney, Agent, or Firm* — Guice Patents PLLC

(57) ABSTRACT

A dual key ring consisting of a ring holder, a first ring and a second ring is disclosed. The ring holder includes a connection tube with a ring hole transversely cut through one end thereof for securing the first ring, a movable block axially movably mounted in the connection tube with a round hole thereof for axial alignment with the ring hole, a locating block mounted in the connection tube, a first elastic member stopped between the movable block and the locating block, a movable cylinder coupled to the connection tube, steel balls rotatably mounted in ball holes around the movable cylinder and rotatably positioned in an inner annular groove in the connection tube, a connection rod mounted in the movable cylinder and stopped against the locating block, a connector coupled to the movable cylinder for securing the second ring and a second elastic member supported between the connection rod and the connector.

8 Claims, 10 Drawing Sheets

DUAL KEY RING

BACKGROUND OF THE INVENTION

1. Field of the Invention

The present invention relates to key ring technology and more particularly, to a dual key ring, which uses a detachable ring holder to secure two rings.

2. Description of the Related Art

As people's everyday lives get more and more convenient, most people carry several different functions of keys on the body, including the key to the door of residence, the door keys, car and motorcycle keys, the company keys and other types of keys. In order to facilitate storage and access to the keys carried by oneself, most people will use a key ring to hold the keys.

A key ring can be a simple split ring, or a double turn ring. When securing keys to a key ring, the user must open the ends of the key ring with force so that the hole in the head of each key can be coupled to the key ring. It is inconvenient to mount and dismount keys in this manner.

U.S. Pat. No. 4,584,858 discloses a device for forming a bunch of keys having a centrally arranged disc from which individual key holder members extend. Ball heads of arms of the key holder members are slidably mounted in an undercut groove in the disc which opens towards the periphery of the disc. The groove has a removal opening for the ball heads which is releasably closed by a slide such that the ball heads can move around in the groove passing by the removal opening.

The aforesaid prior art device facilitating mounting and dismounting of keys, however, its complicated structure does not facilitate fabrication and installation. Further, it can easily get stuck, making removal of loaded keys difficult.

SUMMARY OF THE INVENTION

The present invention has been accomplished under the circumstances in view. It is one object of the present invention to provide a dual key ring, which uses a detachable ring holder to secure two rings.

To achieve this and other objects of the present invention, a dual key ring comprises a ring holder, a first ring and a second ring. The ring holder comprises a connection tube, which comprises a ring hole transversely cut through one end thereof, an axial through hole defined in the one end thereof near to the ring hole and an inner annular groove defined in an opposite end thereof, a movable block that is mounted in the connection tube and that comprises a press portion located on one end thereof and accommodated in the axial through hole and partially extended out of the connection tube and a round hole transversely cut through the periphery thereof and movable with the movable block into axial alignment with the ring hole, a first elastic member, which has one end thereof connected to an opposite end of the movable block remote from the press portion, a locating block mounted in the connection tube in a fixed position and defining therein an accommodation chamber that accommodates an opposite end of the first elastic member, a movable cylinder, which is coupled to the connection tube and comprises a plurality of ball holes spaced around the periphery of one end thereof and a steel ball rotatably mounted in each ball hole and rotatably positionable in the inner annular groove, a connection rod inserted into the movable cylinder with one end thereof stopped against the locating block opposite to the first elastic member, a second elastic member mounted in the movable cylinder around the connection rod with one end thereof stopped against an inside wall of the movable cylinder, and a connector, which is coupled to an opposite end of the movable cylinder and stopped against an opposite end of the second elastic member and comprises a coupling hole transversely cut through one end thereof and a plug hole axially defined in an opposite end thereof for accommodating the connection rod. The first ring is coupled to the connection tube, having a gap defined between two opposite ends thereof. The two opposite ends of the first ring are inserted into the ring hole of the connection tube. The second ring is a double turn ring coupled to the coupling hole of the connector.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
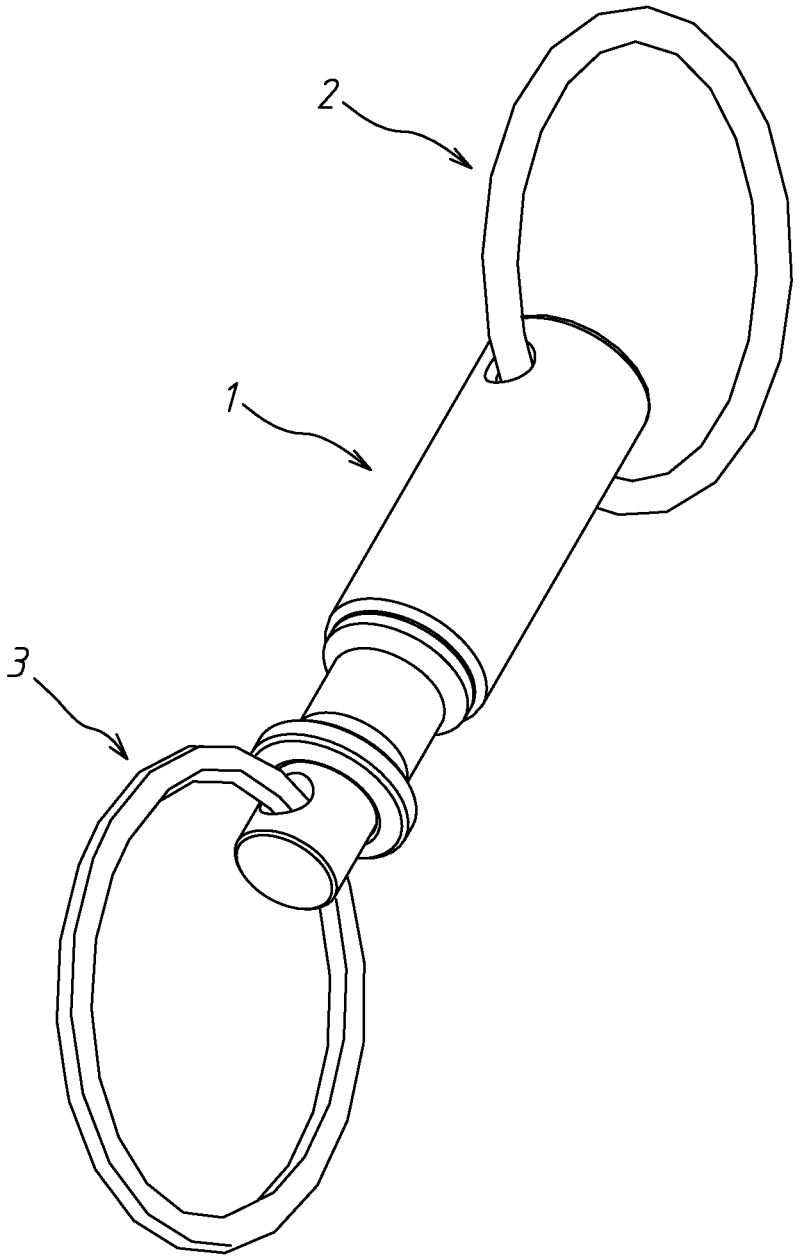
FIG. 1 is an oblique elevational view of a dual key ring in accordance with the present invention.
Figure 2:
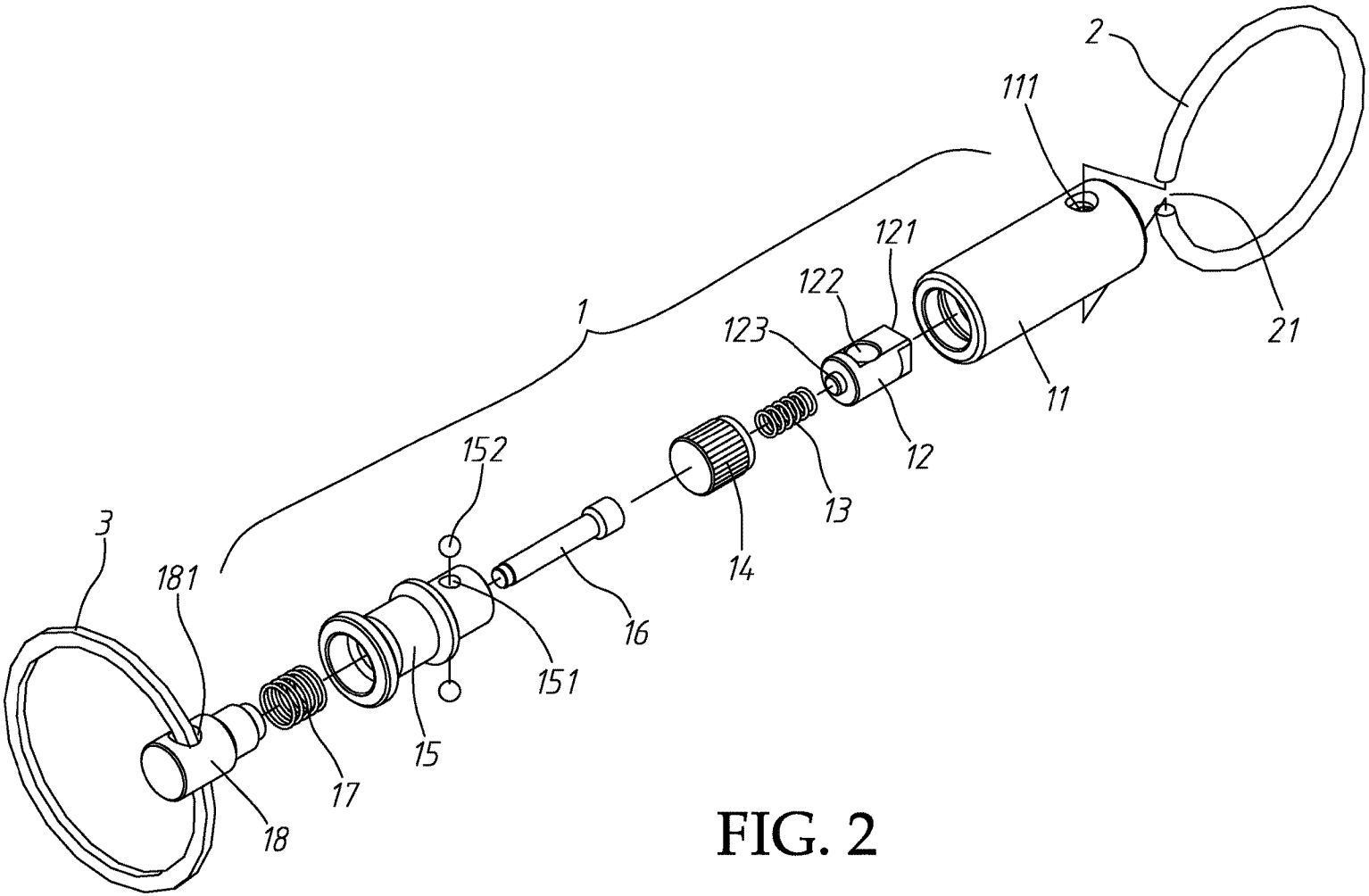
FIG. 2 is an exploded view of the dual key ring in accordance with the present invention.

Referring to FIG. 1 and FIG. 2, a dual key ring in accordance with the present invention is shown. The dual key ring comprises a ring holder 1, a first ring 2 and a second ring 3. The ring holder 1 comprises a connection tube 11, an elongated movable block 12, a first elastic member 13, a locating block 14, a movable cylinder 15, a connection rod 16, a second elastic member 17 and a connector 18.

Figure 3:
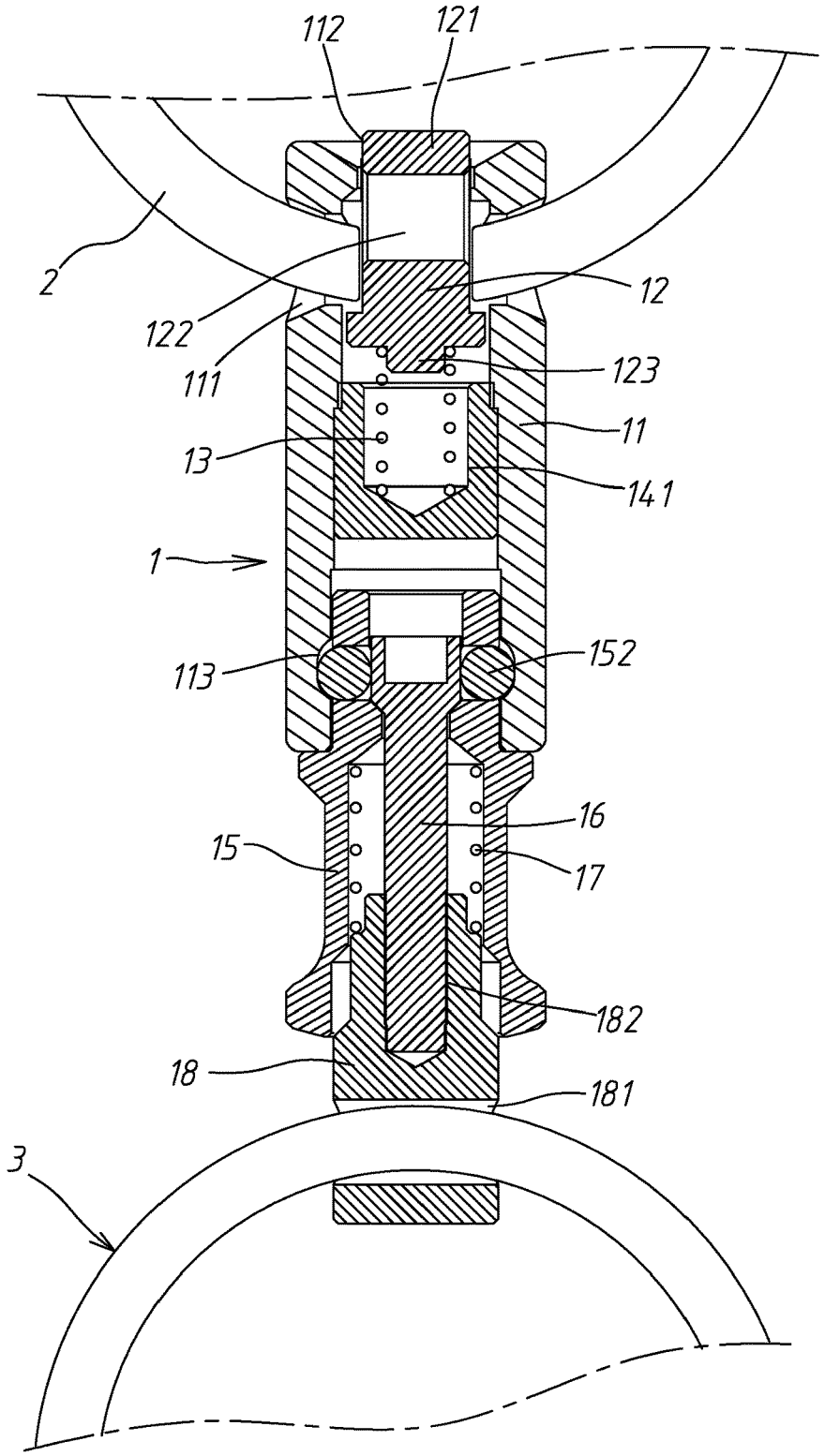
FIG. 3 is a sectional assembly view of the dual key ring in accordance with the present invention.

Referring to FIG. 3 and FIGS. 1 and 2 again, the connection tube 11 comprises a ring hole 111 transversely cut through the periphery of one end thereof for securing the first ring 2, an axial through hole 112 defined in an internally flanged one end thereof adjacent to the ring hole 111, and an inner annular groove 113 extended around an inside wall near an opposite end thereof. The elongated movable block 12 is mounted in the connection tube 11, comprising a rectangular press portion 121 located on one end thereof and received in the axial through hole 112 and partially extended out of the connection tube 11 for pressing by a user to move the movable block 12 axially in the connection tube 11, a round hole 122 transversely cut through the periphery thereof and movable with the movable block 12 into alignment with the ring hole 111 for the passing of the first ring 2 and a round tip 123 axially located on an opposite end thereof.

Referring to FIGS. 2 and 3 again, the first elastic member 13 in the present preferred embodiment is a coil spring mounted in the connection tube 11 with one end thereof attached onto the round tip 123. The locating block 14 is shaped like a round cup and mounted in the connection tube 11 in fixed position, comprising an accommodation chamber 141 that accommodates an opposite end of the first elastic member 13 to give support to the first elastic member 13 against the round tip 123.

Figure 4:
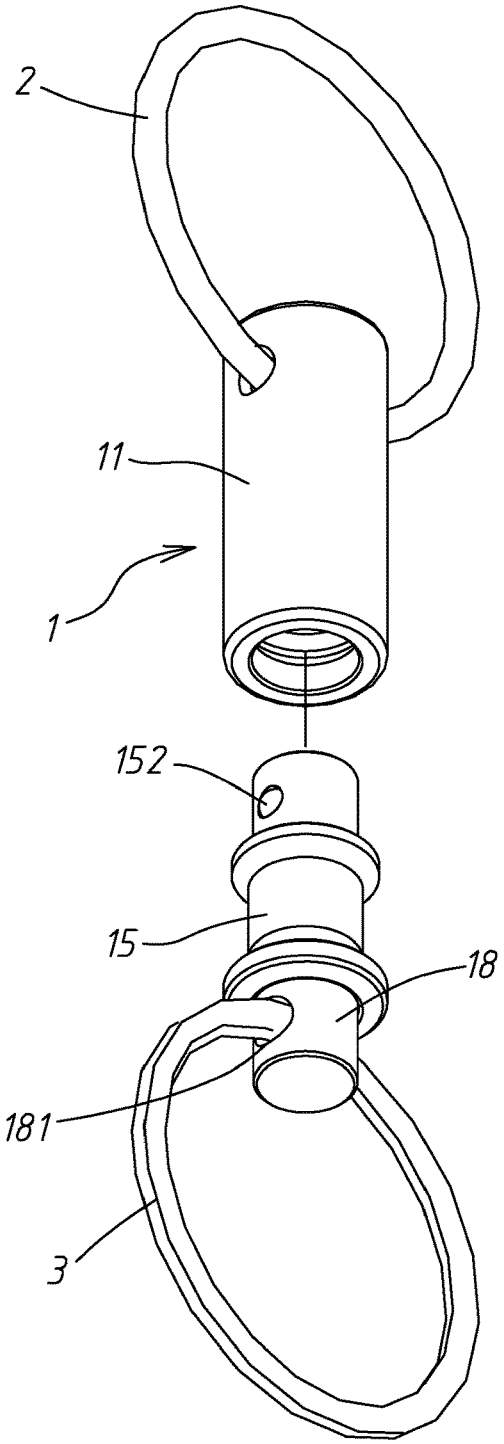
FIG. 4 is an elevational view of the present invention, illustrating the movable cylinder separated from the connection tube.

Referring to FIGS. 2 and 3 again, the movable cylinder 15 is a hollow tubular member connected in series to the connection tube 11, comprising a plurality of ball holes 151 cut through and spaced around the periphery of one end thereof, and a steel ball 152 rotatably mounted in each ball hole 151 for rotatably positioning in the inner annular groove 113. The connection rod 16 is mounted in the movable cylinder 15. After insertion of the movable cylinder 15 into the connection tube 11, the steel balls 152 are rotatably positioned in the inner annular groove 113 and stopped against the periphery of the connection rod 16, and thus, the movable cylinder 15 has its one end secured to the inside of the connection tube 11. The second elastic member 17 in the present preferred embodiment is a coil spring mounted in the movable cylinder 15 around the connection rod 16 with one end thereof stopped at an inside wall of the movable cylinder 15. The connector 18 is shaped like a round rod and coupled with one end thereof to the movable cylinder 15. Further, the connector 18 can be detachably connected to the movable cylinder 15 through the connection rod 16, as illustrated in FIG. 4. Further, the second elastic member 17 has an opposite end thereof attached onto the connector 18. Further, the connector 18 comprises a coupling hole 181 transversely cut through one end thereof for securing the second ring 3, and a plug hole 182 axially defined in an opposite end thereof for receiving the connection rod 16 to secure the relative position between the connector 18 and the movable cylinder 15.

Referring to FIG. 2 again, the first ring 2 is attached to the connection tube 11, having a gap 21 defined between two opposite ends thereof. The two opposite ends of the first ring 2 are disposed in proximity to each other and inserted into the ring hole 111 of the connection tube 11. The second ring 3 is a double turn ring.

Figure 5:
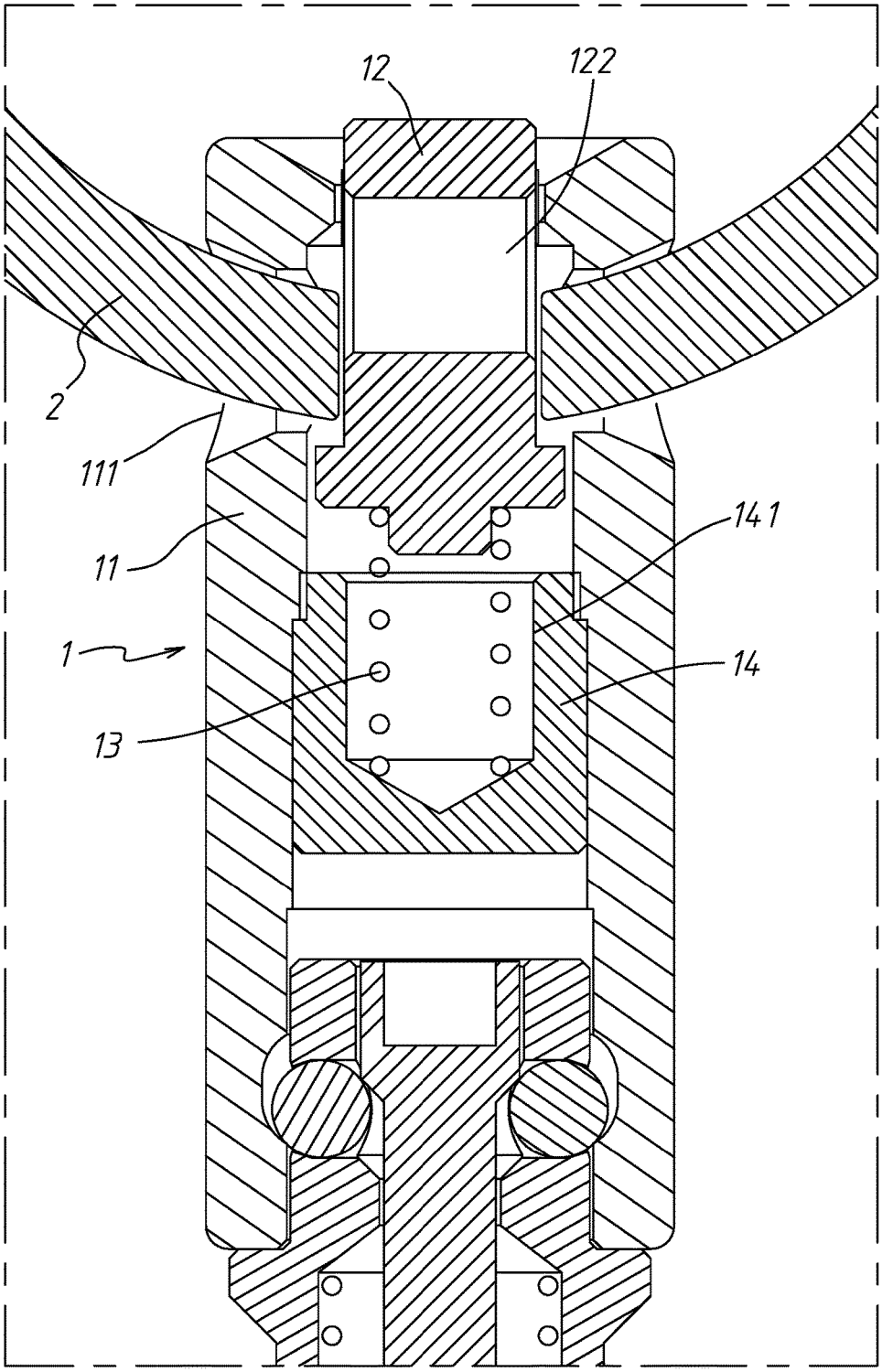
FIG. 5 is a schematic sectional operational view of the present invention, illustrating shifting of the relative position between the elongated movable block and the connection tube (I).
Figure 6:
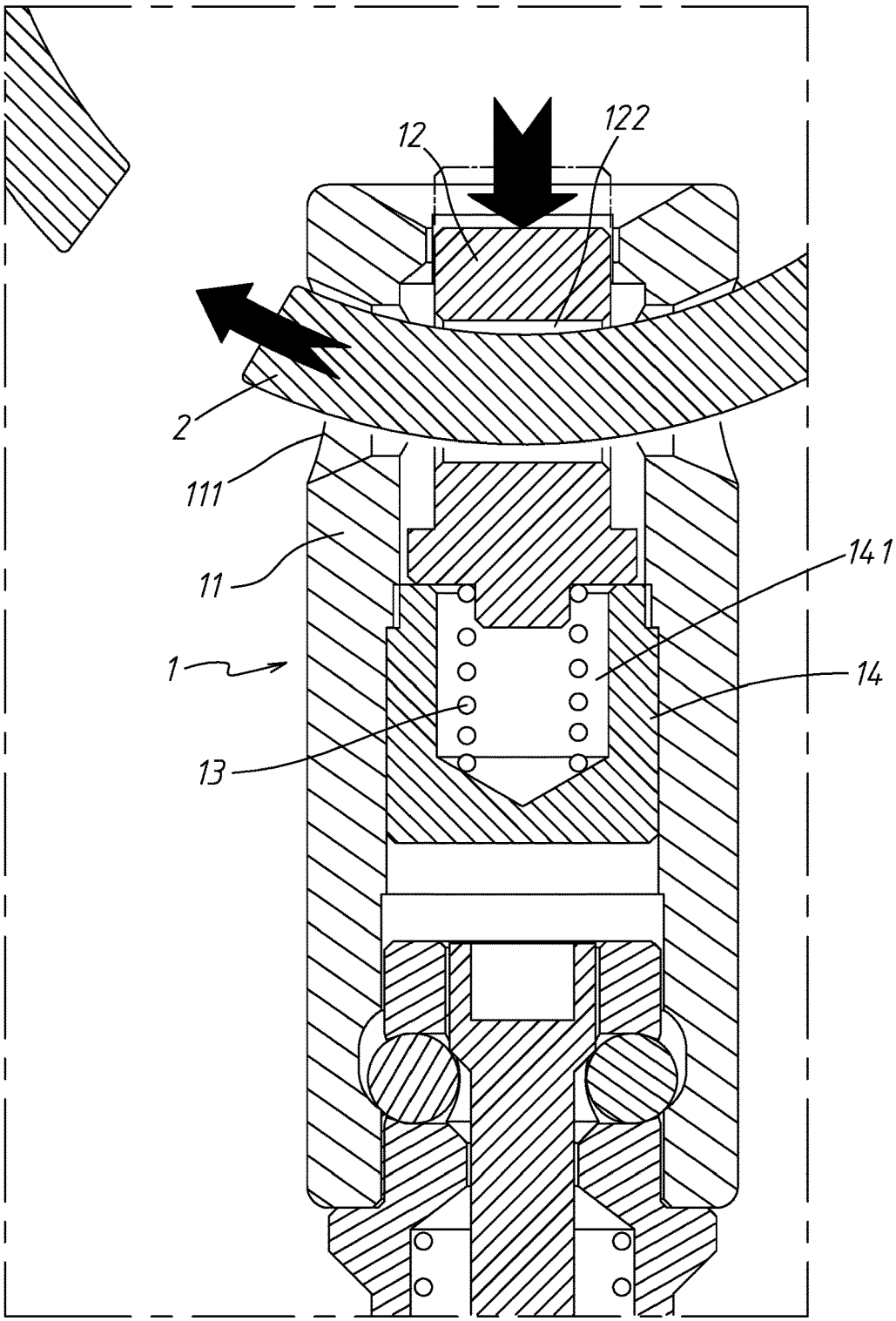
FIG. 6 is a schematic sectional operational view of the present invention, illustrating shifting of the relative position between the elongated movable block and the connection tube (II).

Referring to FIG. 5 and FIG. 6, normally, the ring hole 111 is interrupted by the movable block 12 so that the first ring 2 is prohibited rotation in the ring hole 111 on its own axis. When going to open the gap 21 of the first ring 2, press the press portion 121 of the movable block 12 against the first elastic member 13 to move the round hole 122 of the movable block 12 into alignment with the ring hole 111, see FIG. 6, allowing rotation of the first ring 2 in the ring hole 111 and the round hole 122 (see the arrowheads) to move the gap 21 out of the connection tube 11 for the mounting of a key.

Figure 7:
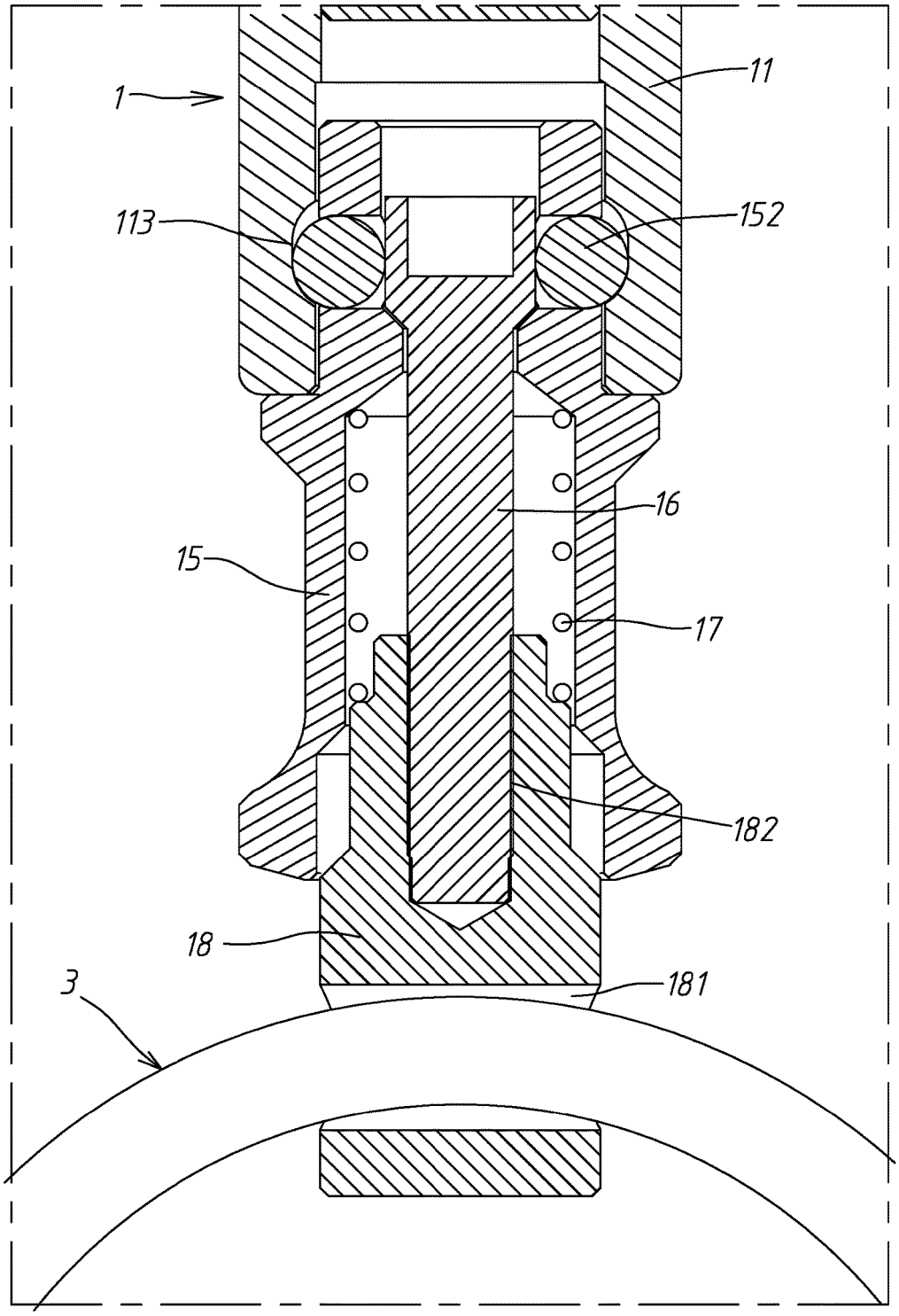
FIG. 7 is a schematic sectional operational view of the present invention, illustrating the separation procedure between the movable cylinder and the connection tube (I).
Figure 8:
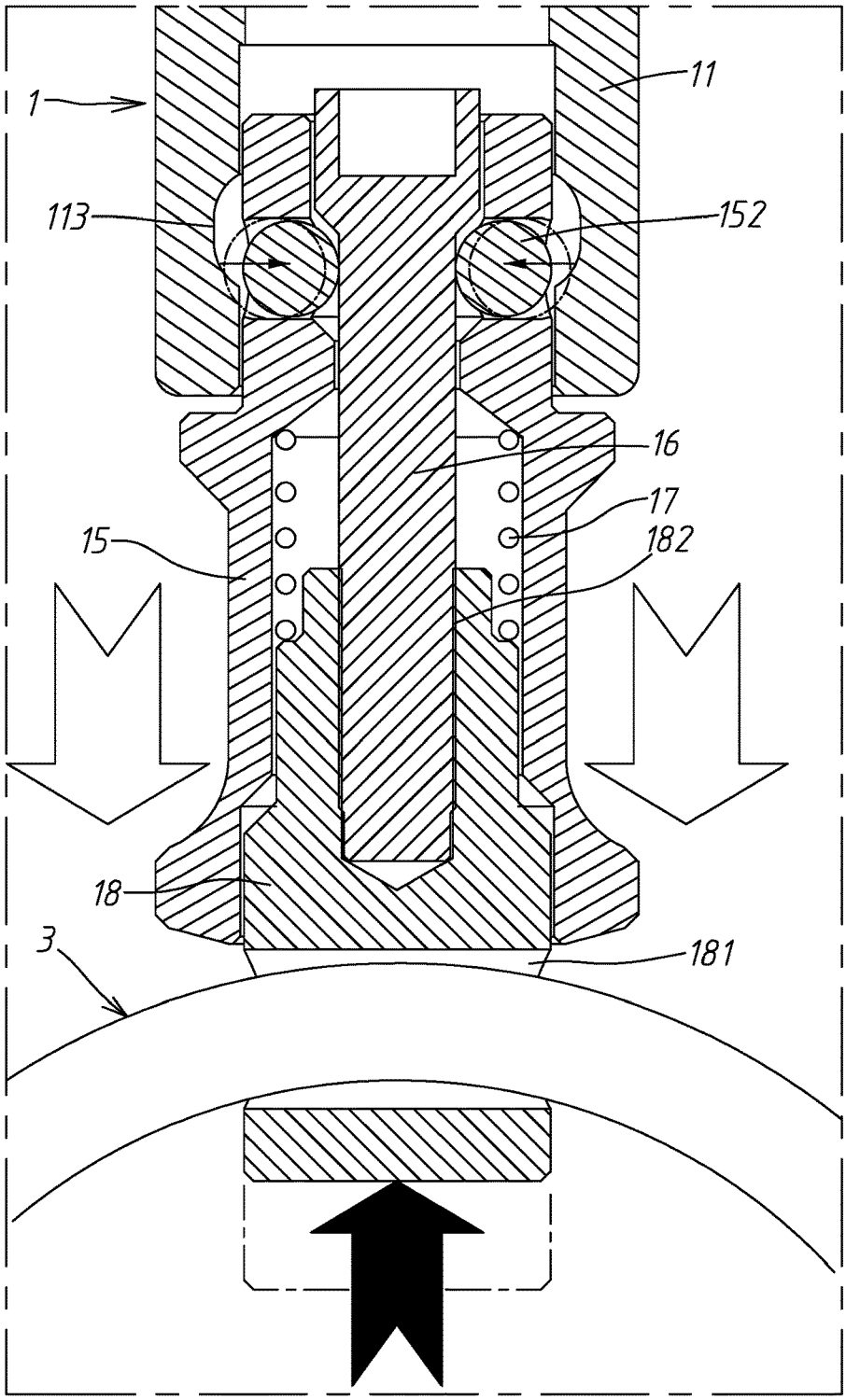
FIG. 8 is a schematic sectional operational view of the present invention, illustrating the separation procedure between the movable cylinder and the connection tube (II).

Referring to FIG. 7 and FIG. 8, the second ring 3 is coupled to the connector 18; the connector 18 is secured to the movable cylinder 15 through the connection rod 16; the movable cylinder 15 and the connection tube 11 are coupled together by means of the riveting effect of the steel balls 152. As illustrated in FIG. 8, when going to separate the movable cylinder 15 and the connection tube 11, push the connector 18 toward the connection tube 11 for causing the steel balls 152 to fall in the respective ball holes 151, at this time, the movable cylinder 15 is released from the constrain of the connection tube 11 for allowing separation between the movable cylinder 15 and the connection tube 11. On the contrary, when going to connect the movable cylinder 15 and the connection tube 11 in series, push the movable cylinder 15 into the connection tube 11 to force the steel balls 152 into the inner annular groove 113. At this time, the connection rod 16 is pushed back by the locating block 14, and thus, the steel balls 152 produce a riveting effect to secure the movable cylinder 15 and the connection tube 11 together.

Figure 9:
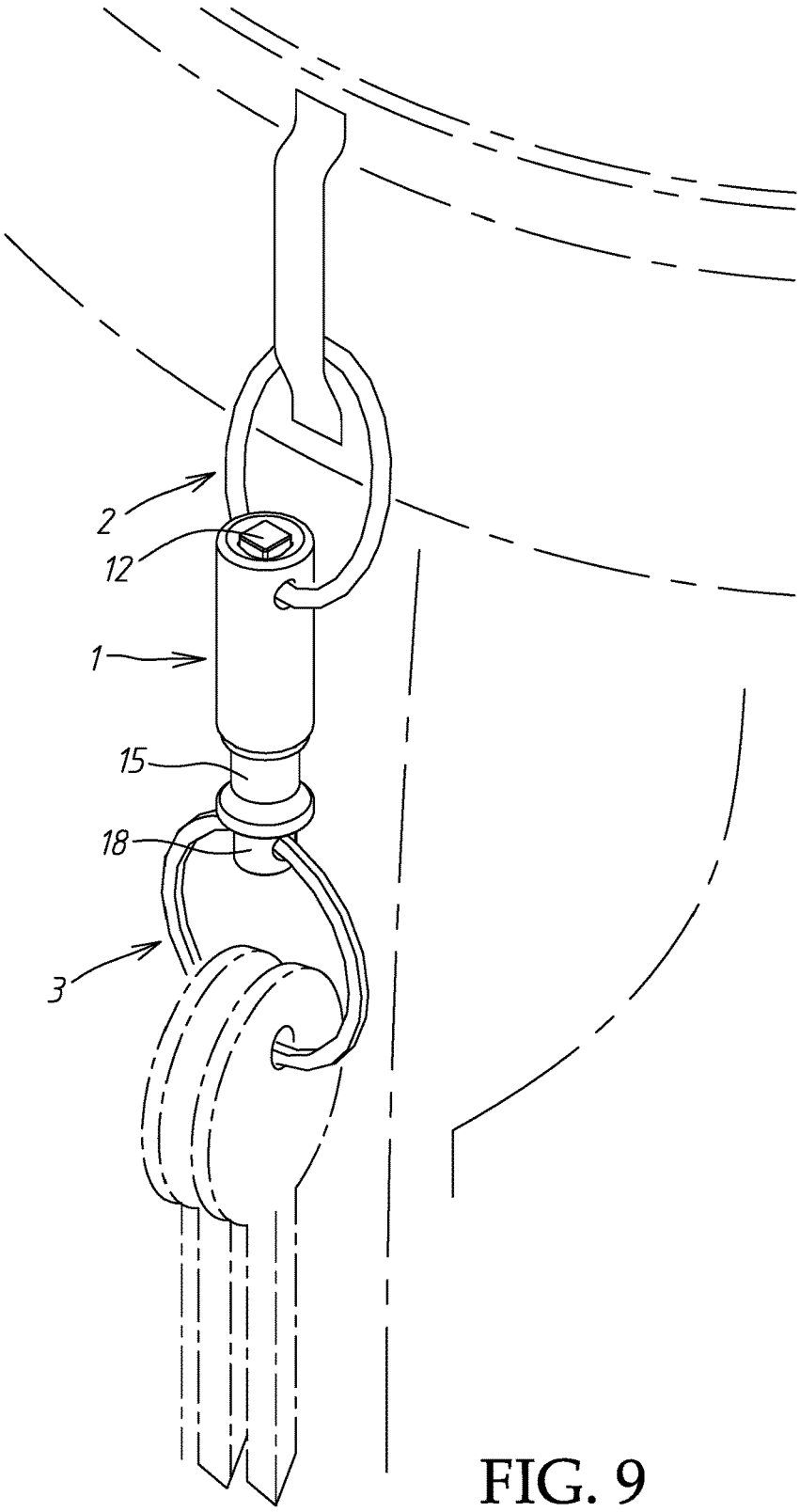
FIG. 9 is a schematic drawing illustrating one application example of the dual key ring in accordance with the present invention.
Figure 10:
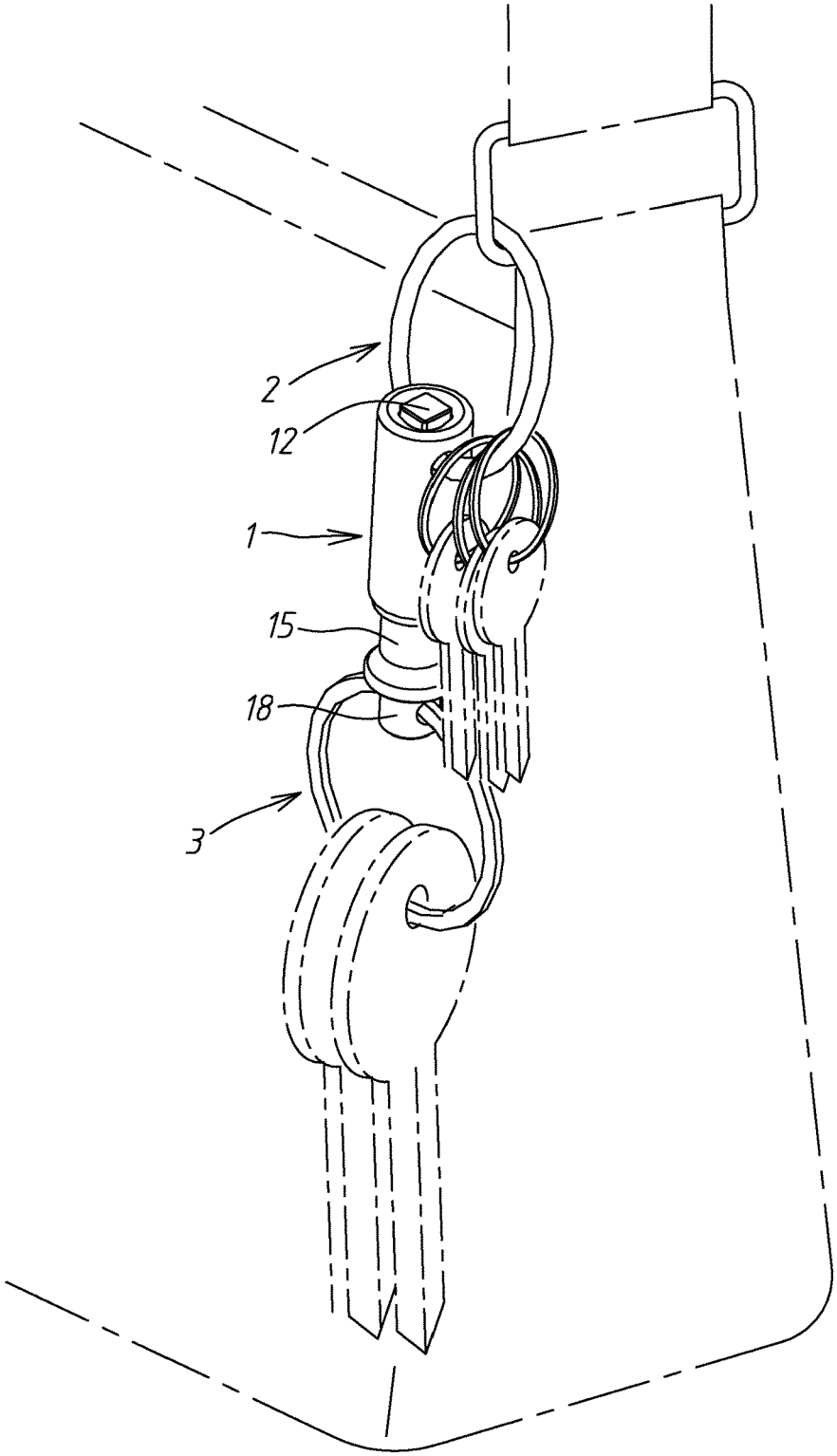
FIG. 10 is a schematic drawing illustrating another application example of the dual key ring in accordance with the present invention.

Referring to FIGS. 9 and 10, in one application example of the present invention, the first ring 2 is used for hanging on a support (see FIG. 9); in another application example of the present invention, the first ring 2 is used for hanging on a support and securing keys (see FIG. 10).

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A dual key ring, comprising:

a ring holder, said ring holder comprising:

a connection tube comprising a ring hole transversely cut through one end thereof, an axial through hole defined in the said one end near to said ring hole and an inner annular groove defined in an opposite end thereof;

a movable block mounted in said connection tube, said movable block comprising a press portion located on one end thereof and accommodated in said axial through hole and partially extended out of said connection tube and a round hole transversely cut through the periphery thereof and movable with said movable block into axial alignment with said ring hole;

a first elastic member having one end thereof connected to an opposite end of said movable block remote from said press portion;

a locating block mounted in said connection tube in a fixed position, said locating block defining therein an accommodation chamber that accommodates an opposite end of said first elastic member;

a movable cylinder coupled to said connection tube, said movable cylinder comprising a plurality of ball holes spaced around the periphery of one end thereof and a steel ball rotatably mounted in each said ball hole and rotatably positionable in said inner annular groove;

a connection rod inserted into said movable cylinder;

a second elastic member mounted in said movable cylinder around said connection rod, said second elastic member having one end thereof stopped against an inside wall of said movable cylinder; and a connector coupled to an opposite end of said movable cylinder and stopped against an opposite end of said second elastic member, said connector comprising a coupling hole transversely cut through one end thereof and a plug hole axially defined in an opposite end thereof for accommodating said connection rod;

a first ring coupled to said connection tube and having a gap defined between two opposite ends thereof, the two opposite ends of said first ring being inserted into said ring hole of said connection tube; and a second ring being a double turn ring coupled to said coupling hole of said connector.

2. The dual key ring as claimed in claim 1, wherein said press portion exhibits a rectangular shape.

3. The dual key ring as claimed in claim 1, wherein said movable block exhibits an elongated shape.

4. The dual key ring as claimed in claim 1, wherein said movable block further comprises a round tip axially extended from an opposite end thereof for holding one end of said first elastic member.

5. The dual key ring as claimed in claim 1, wherein said first elastic member and said second elastic member are coil springs.

6. The dual key ring as claimed in claim 1, wherein said locating block is shaped like a round cup.

7. The dual key ring as claimed in claim 1, wherein said movable cylinder is a hollow tubular member.

8. The dual key ring as claimed in claim 1, wherein said connector is shaped like a round rod.

* * * * *